US006405625B1

(12) United States Patent
Nomura et al.

(10) Patent No.: US 6,405,625 B1
(45) **Date of Patent: *Jun. 18, 2002**

(54) CUTTER DEVICE AND PRINTER INCLUDING A CUTTER DEVICE

(75) Inventors: Akio Nomura; Keiji Murakoshi, both of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/403,565

(22) PCT Filed: Feb. 24, 1999

(86) PCT No.: PCT/JP99/00865

§ 371 (c)(1),
(2), (4) Date: Feb. 7, 2000

(87) PCT Pub. No.: WO99/43503

PCT Pub. Date: Sep. 2, 1999

(30) Foreign Application Priority Data

Feb. 25, 1998 (JP) ..... 10-043163

(51) Int. Cl.[7] ..... B26D 5/08

(52) U.S. Cl. ..... 83/618; 83/214; 83/602; 83/605; 83/611; 83/628; 83/631; 83/633; 83/636; 83/694; 83/697

(58) Field of Search ..... 83/202, 214, 623, 83/560, 563, 564, 597, 601, 602, 603, 604, 605, 611, 613, 618, 627, 628, 629, 630, 631, 632, 633, 636, 694, 697, 582, 584, 620; 400/621

(56) References Cited

U.S. PATENT DOCUMENTS

| | | | | | |
|---|---|---|---|---|---|
| 3,691,890 | A | * | 9/1972 | Kuchyt | 83/624 |
| 3,777,608 | A | * | 12/1973 | Kopf et al. | 83/560 X |
| 5,058,473 | A | * | 10/1991 | Yamada | 83/611 X |
| 5,090,285 | A | | 2/1992 | Kondo | 83/636 |
| 5,105,703 | A | | 4/1992 | Kondo | 83/636 |
| 5,347,699 | A | * | 9/1994 | Ward | 83/202 X |

FOREIGN PATENT DOCUMENTS

| | | |
|---|---|---|
| EP | 0 775 585 | 5/1997 |
| GB | 663958 | 1/1952 |
| JP | 1-289697 | 11/1989 |
| JP | 4-365589 | 12/1992 |
| JP | 5-104484 | 4/1993 |
| JP | 9-19886 | 1/1997 |
| JP | 9-19887 | 1/1997 |

OTHER PUBLICATIONS

IBM Technical Disclosure Bulletin, vol. 31, No. 5, entitled "Receipt Paper Cutoff Mechanism", Oct. 1988, pp. 414–415.

* cited by examiner

*Primary Examiner*—Boyer Ashley
(74) *Attorney, Agent, or Firm*—Nixon & Vanderhye P.C.

(57) ABSTRACT

A printer is provided with a cutter for cutting recording paper in arbitrary lengths or cutting recording paper with a part left after cutting. A pair of movable blades, at least one of which is displaced in a direction approximately orthogonal to the paper path, are driven in a cooperative relationship to effect a cutting operation with a fixed blade. The dispersion of force required for tearing off the cut recording paper is reduced, a torn trace of a left part after cutting the recording paper looks nice, and the position of a left part after cutting the recording paper can be arbitrarily set respectively without increasing the size in the direction of the recording paper width.

13 Claims, 8 Drawing Sheets

CUTTER DEVICE AND PRINTER INCLUDING A CUTTER DEVICE

TECHNICAL FIELD

The present invention relates to a printer used for a point-of-sale (POS) transaction for example such as an electronic cash register, and particularly relates to a printer provided with a cutter device for cutting recording paper so that it has arbitrary length or cutting recording paper with a left or remaining part after cutting partly provided.

BACKGROUND ART

Heretofore, for this type cutter device, a cutter device which is provided with a fixed blade and a movable blade installed with a transport path between them and which cuts recording paper by moving the movable blade and crossing it and the fixed blade is well-known.

The cutter device includes a movable blade formed by tilting its line to the tip by a predetermined angle with a direction in which the movable blade is moved, and recording paper is cut continuously from one side to the other side. Such a cutter device is disclosed in Japanese published unexamined patent application No. Hei4-365589.

Also, for another example showing prior art, a cutter device includes a movable blade with a notched line to the tip that is moved, and recording paper is cut from both sides. Such a cutter device is disclosed in Japanese published unexamined patent application No Hei1-289697 and Japanese published examined patent application No. Hei8-22517.

Further, a cutter device includes movable blades installed on the right and left sides of a transport path so that they can be turned, and recording paper is cut from both sides according to a clipping method. Such a cutter device is disclosed in Japanese published unexamined patent application No. Hei.5-104484.

However, such conventional type cutter devices have the following problems.

In the case of such types of cutters, it is required to prevent cut recording paper from being lost before an operator catches it, and the recording paper is partly left after cutting.

As for the cutter device disclosed in Japanese published unexamined patent application No. Hei4-365589, as a left part after cutting is on the side of the recording paper and a transport path is formed so that the width is slightly wider than the width of recording paper, there can be occurrences that the left part after cutting is wide because the position of the recording paper is biased right or left, and it is difficult to fix the width of a left part after cutting.

If a left part after cutting is wide, there is a problem that the recording paper on a transport path is pulled out when an operator tears off the left part after cutting the recording paper, a trace of the torn left part is diagonal, and a bad impression of it is made. Conversely, if a left part after cutting is too narrow, there is a problem that the left part is torn off before an operator catches it.

In the meantime, the cutter device disclosed in Japanese published examined patent application No. Hei.8-22517 does not have the above problems, however, as a left part after cutting is in the center of the width of the recording paper, there is a problem that cut recording paper is tilted right or left, its posture is not stable, and it is difficult for an operator to catch it. As the condition of right and left notched blades varies, a load applied to the movable blades becomes unbalanced, the movable blades are tilted, stable cutting is disabled, and the quality of cutting may be deteriorated if a left part after cutting is shifted from the center of the width of the recording paper to solve the above problem.

Also, as for the cutter device disclosed in Japanese published unexamined patent application No. Hei5-104484, as space is required on both right and left sides of a transport path to provide the rotating shaft of movable blades according to a clipping method on both sides of the transport path, there is a problem that the whole printer is large-sized in the direction of the width.

The present invention is made to solve the above problems of prior art, and the object is to provide a cutter device wherein the recording paper can be torn with a light stable force, a torn trace looks nice, and in addition, the position of a left part after cutting the recording paper can be set to a position shifted from the center of the width and the size in the direction of the width of the recording paper is miniaturized. A printer using the cutter device is also provided.

SUMMARY OF THE INVENTION

A cutter device according to the present invention is provided with a fixed blade arranged in the vicinity of one side of a transport path for carrying recording paper, and a first movable blade moved from a position where the first movable blade is opposed to the fixed blade with the transport path toward a direction approximately orthogonal to the transport path to slidably cross the fixed blade. A second movable blade is arranged adjacent the first movable blade at a predetermined position in a direction of the width of recording paper, which is moved from a position where the second movable blade is opposed to the fixed blade with the transport path toward a direction approximately orthogonal to the transport path to slidably cross the fixed blade. A driving mechanism is provided for moving the first movable blade and the second movable blade.

According to the above configuration, as the first and second movable blades which are moved from a position where the first movable blade is opposed to the fixed blade with the transport path toward a direction approximately orthogonal to the transport path to slidably cross the fixed blade, a left part after cutting of recording paper can be set to a position other than the side of the recording paper, and the dispersion of the width of the left part is reduced, pulling recording paper with stable force is enabled, and it is enabled to make a torn trace look nice.

In addition, in the case of the present invention, as the first and second movable blades are separately included and the condition of cutting is independent, the difference in the condition of cutting between both blades has no bad effect upon each, even if a left part after cutting is shifted from the center of the width of the recording paper.

Further, according to the present invention, as two movable blades approximately equal to the width of recording paper are included, a small-sized cutter can be provided.

Also, a cutter device according to the present invention is provided with a fixed blade arranged in the vicinity of one side of a transport path for carrying recording paper, and a first movable blade pivotally supported about a pivot so that the first movable blade is moved from a position where the first movable blade is opposed to the fixed blade with the transport path toward a direction across the transport path to slidably cross the fixed blade. A second movable blade is moved from a position where the second movable blade is opposed to the fixed blade toward a direction approximately orthogonal to the transport path to slidably cross the fixed blade. A driving mechanism is provided for moving the first movable blade and the second movable blade.

According to the above configuration, as the so-called scissors-type movable blade is used for the first movable blade, a driving force for moving the first movable blade can be reduced, particularly, if the first and second movable blades are included so that they are interlocked, the driving mechanism can be simplified, and a driving force for moving both movable blades can be reduced. Further, as only the first movable blade is of a scissors type, the size in the direction of the width of recording paper is not required to be increased, and in addition, the cutter with the sharpness of the blades can be provided.

It is also effective that the present invention is included so that the first and second movable blades are interlocked by the link mechanism.

According to the above configuration, the first and second movable blades can be driven by one driving motor, and a cutter with a simple configuration can be acquired.

It is also effective that the present invention is included so that an engaging part is provided to the first and second movable blades, and the first and second movable blades are interlocked by engaging the engaging portions.

According to the above configuration, as the link mechanism is not required, a cutter device with a further simple configuration can be acquired.

Further, in the case of the present invention, as a fixed blade supporting mechanism by which the fixed blade can be separated from the first and second movable blades is provided, setting of recording paper is facilitated, and removal of jammed paper in a paper jam is also easy.

With a printer incorporating the cutter device of the invention, the size in the direction of the width of recording paper is not required to be increased, a force required for tearing off the recording paper hardly varies, a torn trace of a left part after cutting of the recording paper looks nice, and in addition, the position of the left part of the recording paper can be arbitrarily set.

DETAILED DESCRIPTION OF THE INVENTION

Figure 1:
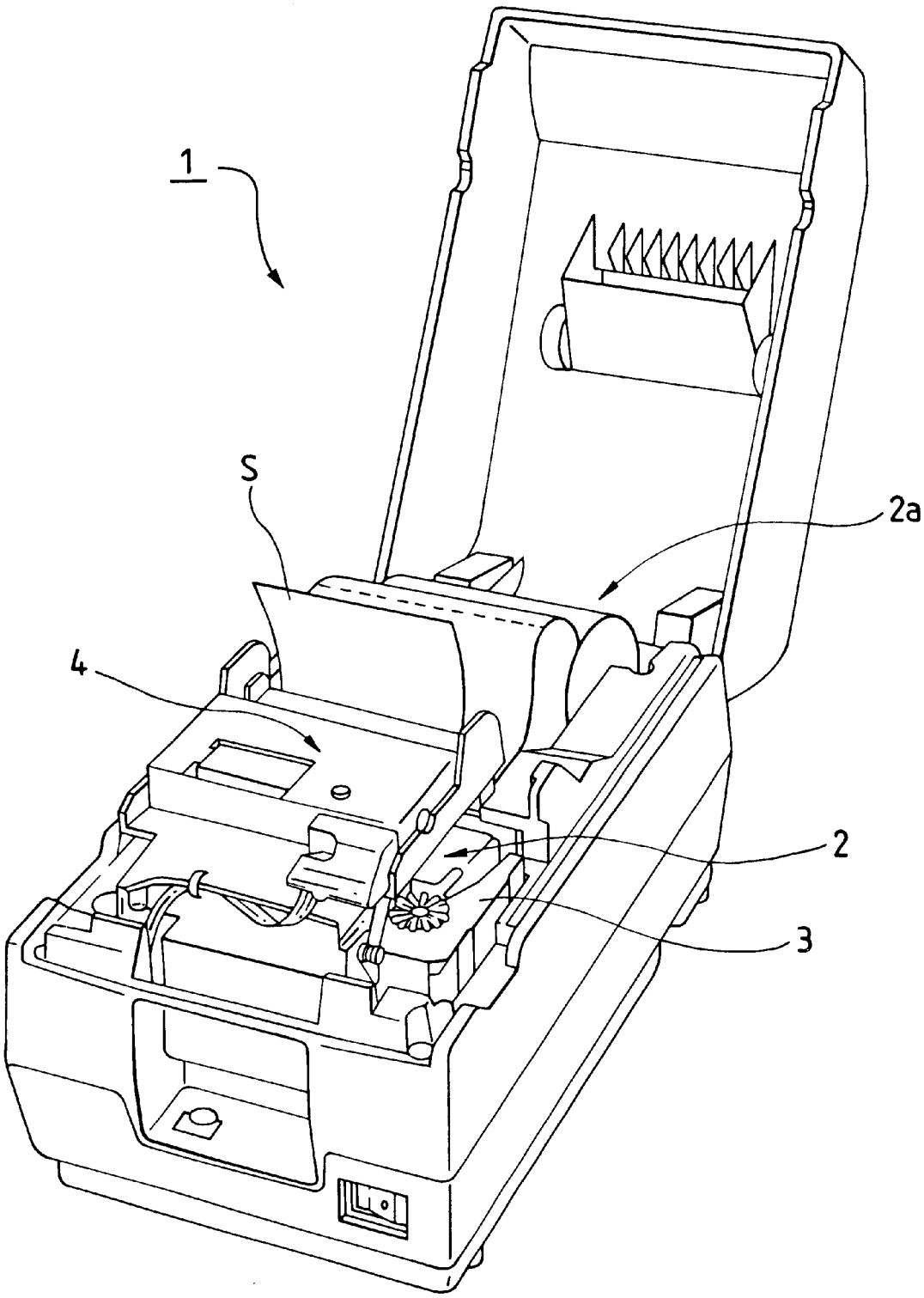
FIG. 1 is a perspective view showing the appearance of a first embodiment of a printer according to the present invention, FIGS. 2(*a*) and 2(*b*) are a plan view and a front view showing the configuration of a cutter device in this embodiment, and FIGS. 3(*a*) and 3(*b*) are a plan view and a front view showing the arrangement and the fitting of a fixed blade and a movable blade in this embodiment.

Referring to the drawings, embodiments of a cutter device according to the present invention and a printer using it will be described in detail below.

FIG. 1 is a perspective view showing a printer.

As shown in FIG. 1, a printer 1 is a dot impact printer applied to an electronic cash register used for POS transactions and others and include the body 2 of the printer from which a ribbon cassette 3 can be detached and the housing 2*a* of recording paper S provided at the back of the body 2.

A print head (not shown) for executing predetermined printing on recording paper S, a paper feeding mechanism (not shown) for feeding the recording paper S to a printing position, and a cutter device 4 for cutting the printed recording paper S are secured to the body 2.

As shown in FIG. 1, the cutter device 4 is provided above the body 2.

Figure 2A:
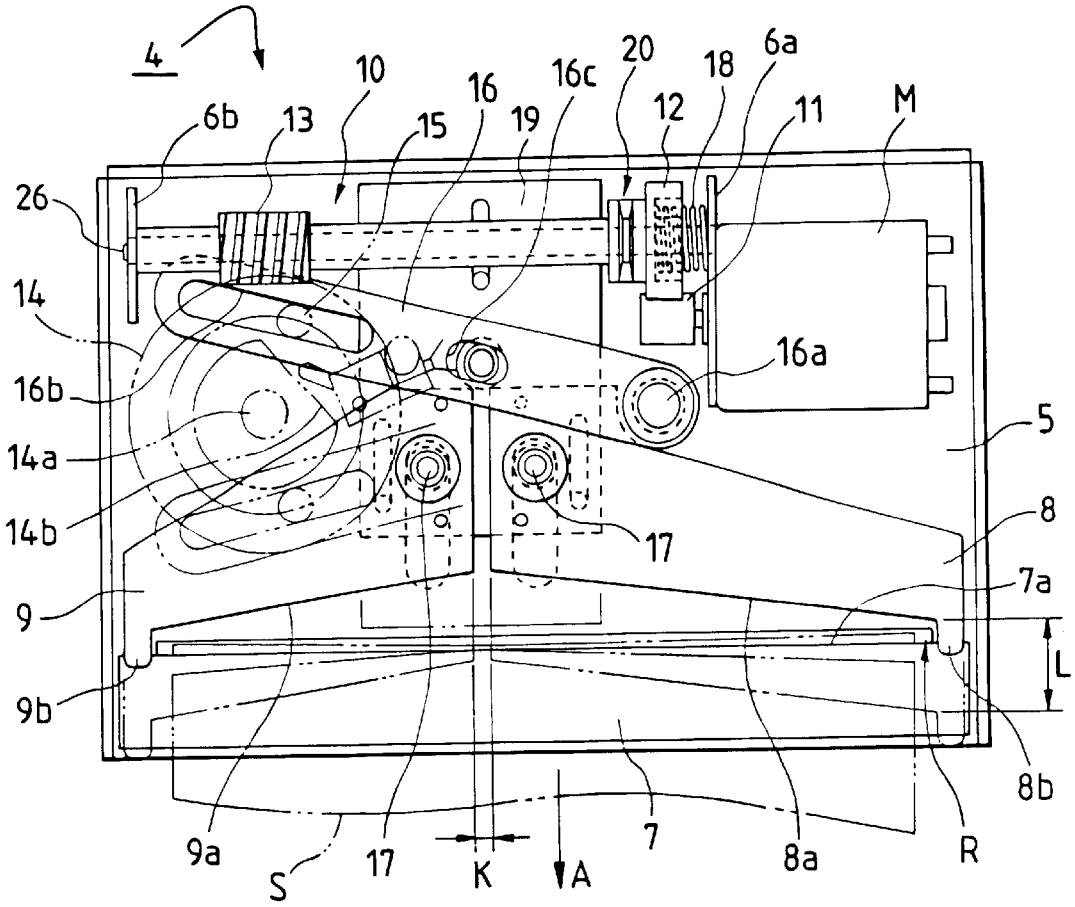
Figure 2B:
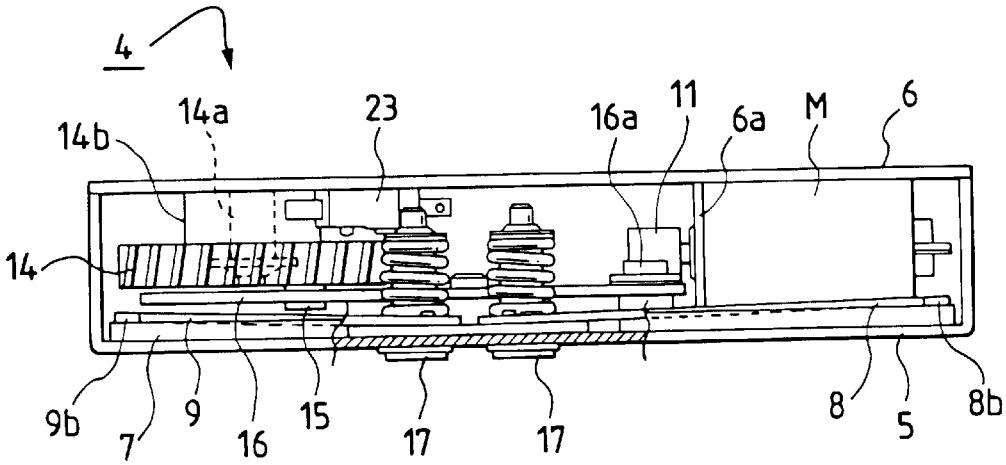
Figure 3A:
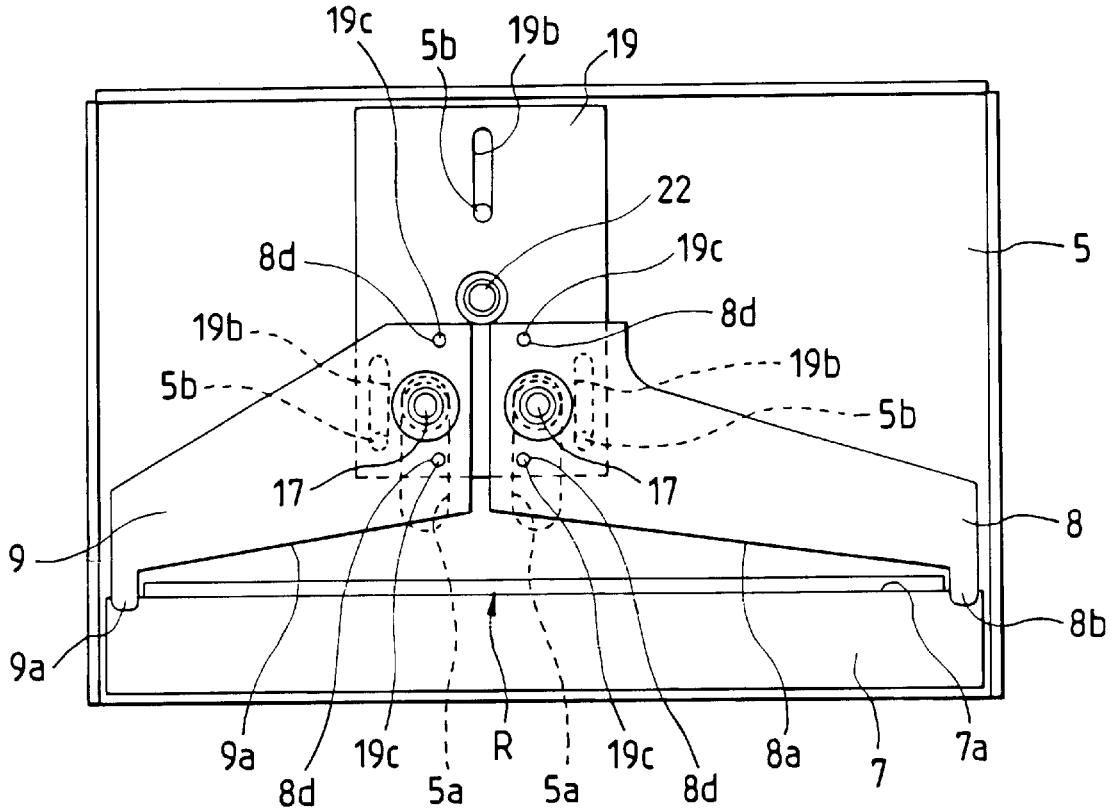
Figure 3B:
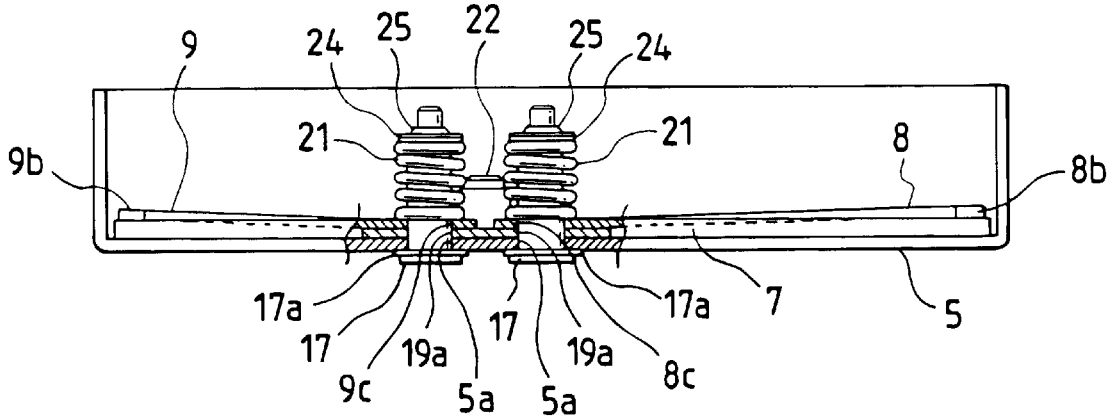

FIG. 2(*a*) is a plan view showing the configuration of the first embodiment of the cutter device according to the present invention, and a cutter device cover 6 covering the upper surface is not shown to show the internal structure. FIG. 2(*b*) is a front view showing the configuration of the cutter device. FIG. 3(*a*) is a plan view showing the arrangement and the fitting of a fixed blade and a movable blade in this embodiment, and FIG. 3(*b*) is its front view.

As shown in FIGS. 2(*a*) and 2(*b*), the cutter device 4 in this embodiment is provided with a housing including a cutter frame 5 and a cutter cover 6.

The cutter frame 5 includes a box-type member made by bending a metallic plate such as a plated steel plate and as shown in FIG. 3, the fixed blade 7 made of stainless steel is fixed to one side with a longer edge. In this embodiment, the fixed blade 7 includes a long member.

On the opposite side of the fixed blade 7 with the transport path R of recording paper S between them, a first movable blade 8 and a second movable blade 9 respectively made of stainless steel and formed substantially in the shape of a triangle are provided. In this embodiment, as a left part after cutting is set off from the center of the width of recording paper, the first movable blade 8 is formed so that it is larger than the second movable blade 9.

At each end of the first and second movable blades 8 and 9 off the transport path R, movement guiding parts 8*b* and 9*b* protruded on the side of the fixed blade 7 are formed, and these movement guiding parts 8*b* and 9*b* are constituted so that the movable blades 8 and 9 are also above the fixed blade 7 on standby. Each line to the tip of the cutting parts 8*a* and 9*a* of the first and second movable blades 8 and 9 is tilted by a predetermined angle with a line to the tip of the cutting part 7*a* of the fixed blade 7 so that an interval between the cutting part 7*a* of the fixed blade 7 and the cutting part 8*a* or 9*a* of the first or second movable blades 8 or 9 becomes longer toward the center from both ends of the fixed blade 7.

As shown in FIG. 2(*a*), the first movable blade 8 and the second movable blade 9 are arranged apart by a predetermined distance K in the vicinity of the center of the fixed blade 7. By such constitution, each line to the tip of the cutting parts 8*a* and 9*a* of the first and second movable blades 8 and 9 is formed so that a line to the tip of the cutting part 7*a* of the fixed blade 7 forms a substantially V shape.

In this embodiment, the first and second movable blades 8 and 9 are driven by a driving mechanism 10 having the following structure. As shown in FIG. 2(*a*), the driving mechanism includes a driving motor M, a motor gear 11 for transmitting the torque of the driving motor M to the first and second movable blades 8 and 9, a reduction gear 12, a worm 13 and a driving gear 14. In this embodiment, the driving mechanism 10 is attached to the cutter cover 6.

The driving motor M is fixed to a mounting plate 6*a* bent from the cutter cover 6 with screws and the like. The reduction gear 12 and the worm 13 are supported by a metallic reduction shaft 26 put between the mounting plates 6*a* and 6*b* and fixed to them so that the reduction gear and the worm can be rotated. A clutch 20 is formed on the respective opposite end faces of the worm 13 and the reduction gear 12. In detail, the clutch 20 includes mutually engaged ratchets formed in the rotational direction of the respective end faces opposite to the worm 13 and the reduction gear 12, though the ratchets are not shown in the drawing, and a clutch spring 18 for pressing the reduction gear 12 which can be moved on the reduction shaft 26 in the axial direction on the worm 13.

The disc-like driving gear 14 engaged with the worm 13 is mounted around a spindle 14*a* fixed to the cutter cover 6 so that the driving gear can be turned, and a driving pin 15 is provided to the upper surface of the driving gear 14. A long metallic link lever 16 is attached to the cutter frame 5 via a spindle 16*a* so that the link lever can be turned, a long hole 16*b* formed at the end of the link lever 16 and the driving pin 15 of the driving gear 14 are fitted and the link lever 16 is constituted so that it is turned as the driving gear 14 is turned.

Further, a long hole 16*c* formed in the middle of the link lever 16 and a slide driving pin 22 provided to a slide plate 19 described later are fitted so that the slide plate 19 is reciprocated as the link lever 16 is turned.

As shown in FIG. 3(*a*), the slide plate 19 includes a square metallic member and in the center, the slide driving pin 22 is provided. Three long holes 19*b* extended in the longitudinal direction and four projections 19*c* protruded on the upper side are also provided to the slide plate 19. The long hole 19*b* of the slide plate 19 is formed so that it is fitted to a projection 5*b* protruded on the upper side from the cutter frame 5, and the projections 19*c* of the slide plate 19 are formed so that they are respectively fitted into holes 8*d* and 9*d* provided to the first and second movable blades 8 and 9.

A pressure shaft 17 is provided in the vicinity of the center of fittings mounted with them overlapped with the first or second movable blade 8 or 9. As shown in FIG. 3(*b*), the pressure shaft 17 pierces a long hole 5*a* of the cutter frame 5, the hole 19*a* of the slide plate 19 and a hole 8*c* or 9*c* of the first or second movable blade 8 or 9 via a washer 17*a*.

The first and second movable blades 8 and 9 press the cutter frame 5, the movement guiding parts 8*b* and 9*b*, and the cutting parts 8*a* and 9*a* of the first and second movable blades 8 and 9 on the fixed blade 7 via the slide plate 19 by stopping a helical compression spring 21 wound on the pressure shaft 17 with a retaining ring 25 via a washer 24.

The strength of the helical compression spring 21 is set according to the degree of the respective inclination, the shear angle and the like of the first and second movable blades 8 and 9.

As shown in FIG. 3(*b*), the slide plate 19 is formed so that it is thinner than the thickness of the fixed blade 7, and a suitable tilt angle is applied to the first and second movable blades 8 and 9.

As shown in FIG. 2(*b*), a detector 23 is attached to the cutter cover 6 above the driving gear 14, and the waiting position of the first and second movable blades 8 and 9 is detected depending upon whether the detector 23 is in contact with a cam 14*b* provided to the driving gear 14 or not.

In this embodiment provided with such configuration, when the driving motor M is driven, its torque is transmitted to the driving gear 14 via the motor gear 11, the reduction gear 12 and the worm 13, the driving gear 14 is rotated and as a result, the link lever 16 is moved from a position shown by a full line in FIG. 2(*a*) to a position shown by an alternate long and two short dashes line. In this case, as the long hole 19*b* of the slide plate 19 is guided in a direction shown by an arrow A by the projection 5*b* of the cutter frame 5, the first and second movable blades 8 and 9 fitted to the slide plate 19 are also moved in the direction shown by the arrow A, and when the cutting parts 8*a* and 9*a* of the first and second movable blades 8 and 9 are slid on the cutting part of the fixed blade 7 by distance L, recording paper S is cut.

When a foreign matter and the like are put between the first or second movable blades 8 or 9 and the fixed blade 7 and they are locked during cutting, the members composing the cutter device are protected because a slide occurs in the clutch between the reduction gear 12 and the worm 13.

As described above, according to this embodiment, as a left part after cutting of recording paper S can be set so that it is in a position other than the side of the recording paper S and in addition, it is fixed because the first and second movable blades 8 and 9 which can cross the fixed blade 7 and can be slid on the fixed blade 7 are provided, the length of the left part after cutting is fixed even if the recording paper S is cut with it biased on either side of the right or the left in a transport path, and the impression of a cut part can be enhanced without increasing a force for pulling paper when the recording paper is cut.

In addition, in this embodiment, as the first and second movable blades 8 and 9 are separately included, the condition of cutting of the movable blade and the fixed blade is unchanged even if loads on the respective blades are different if the left part after cutting is off the central part of the width of recording paper S, a problem such as a failure of cutting where the recording paper is drawn between the movable blade and the fixed blade because the pressure of one movable blade is reduced by unbalance, such as occurs in prior art, does not occur, and the quality of cutting is not deteriorated.

Further, according to this embodiment, as the first and second movable blades 8 and 9 comply with a sliding method, the movement of the movable blade can be limited to a range approximately equal to the width of recording paper S, and a small-sized cutter device can be provided.

In addition, according to this embodiment, as the link lever 16 composing a link mechanism is fitted to the first and second movable blades 8 and 9, a cutter device of a simple configuration can be acquired.

Figure 4:
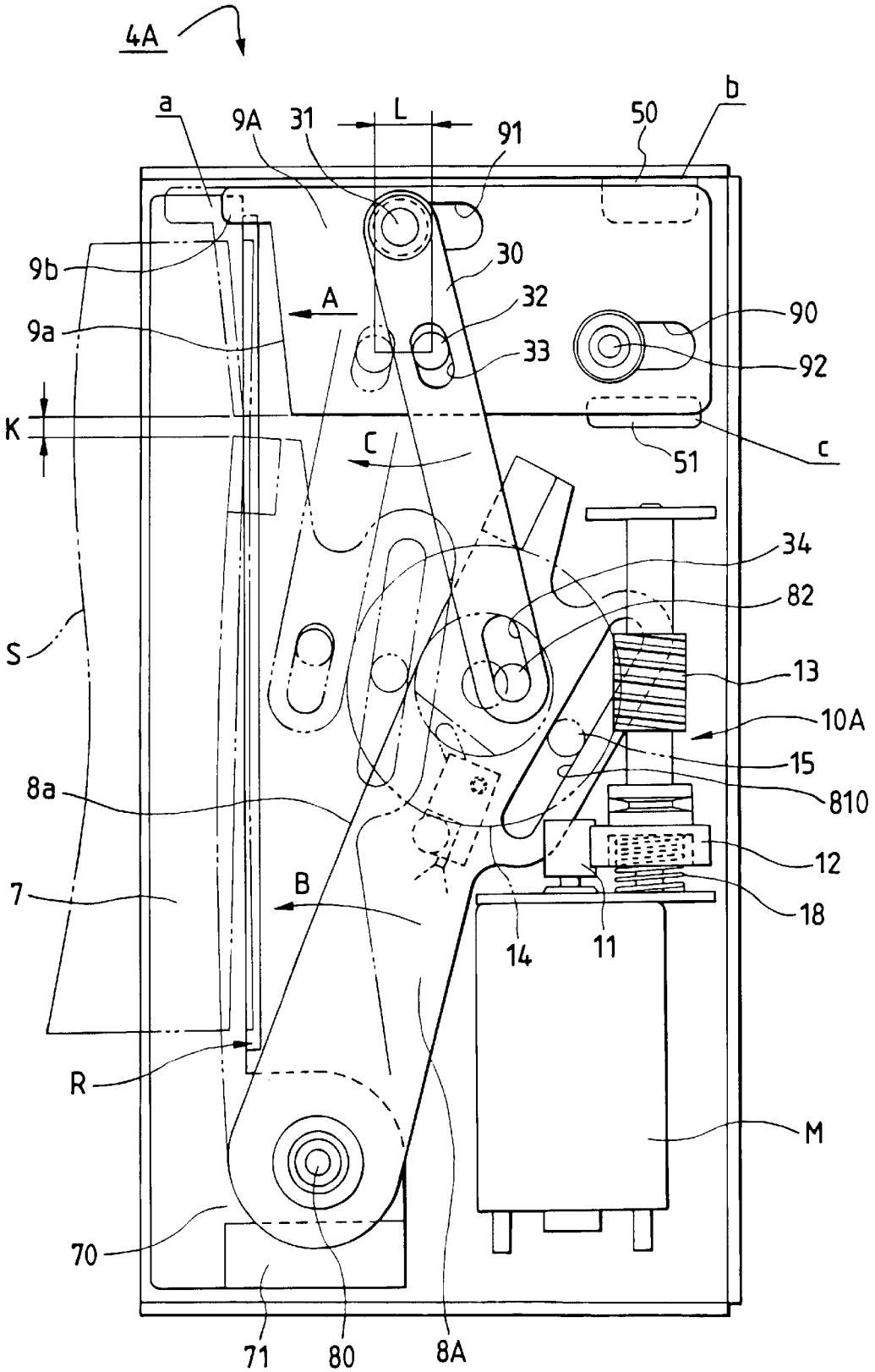
FIG. 4 is a plan view showing the configuration of a second embodiment of the present invention, FIGS. 5(*a*) and 5(*b*) are a front view showing the configuration of a cutter device in this embodiment and a sectional view showing a part in which a pressure shaft is mounted.
Figure 5B:
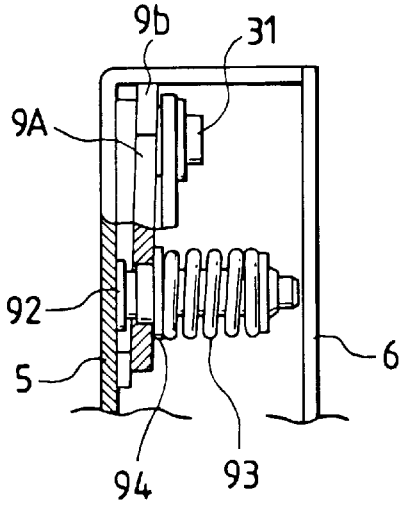
Figure 5A:
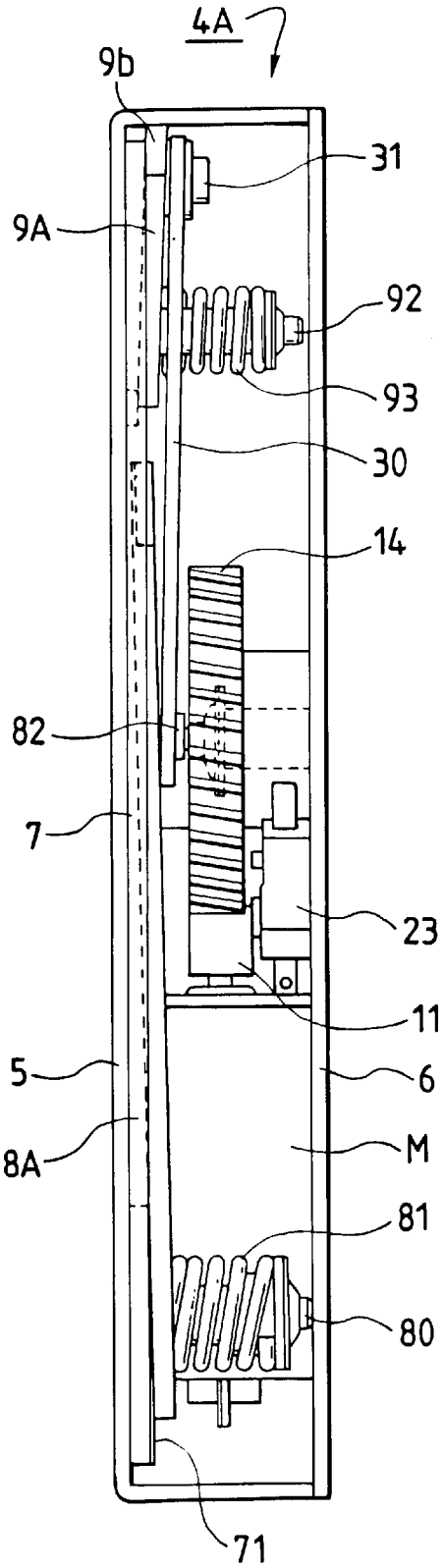
Figure 6:
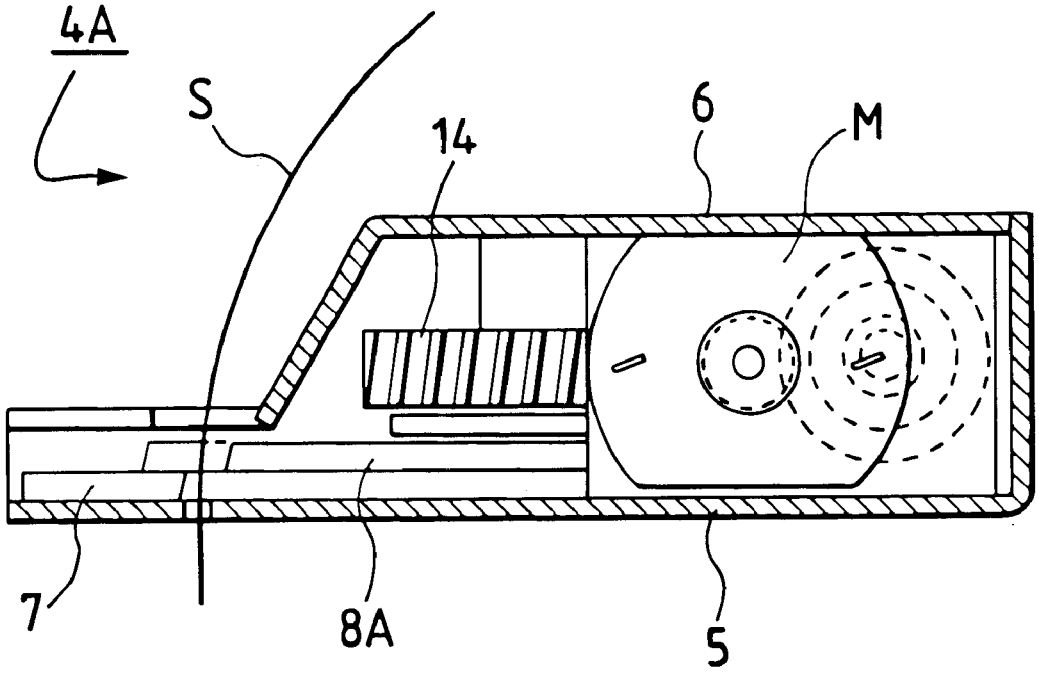
FIG. 6 is a side view showing the configuration of the cutter device in this embodiment.

FIG. 4 is a plan view showing the configuration of a second embodiment of the cutter device according to the present invention. A cutter cover 6 covering the upper surface is not shown to show the internal structure. FIG. 5(*a*) is a front view showing the configuration of the cutter device, FIG. 5(*b*) is a sectional view showing the fittings of the pressure shaft of the cutter device, and FIG. 6 is a side view showing the configuration of the cutter device. Parts common to those in the above embodiment will be described below using the same reference numbers.

A cutter device 4A equivalent to this embodiment includes a so-called scissors-type first movable blade 8A in a driving mechanism 10A. As shown in FIG. 4, in this embodiment, a fixed blade 7 is provided to one edge of a cutter frame 5, and the first movable blade 8A having a predetermined length is provided to the base 70 of the fixed blade 7 so that the first movable blade can be turned with a pivot 80 in the center.

As shown in FIG. 5(*a*), a helical compression spring 81 for pressing the first movable blade 8A on the fixed blade 7 is wound on the pivot 80. A spacer 71 between the fixed blade 7 and the first movable blade 8A is fixed to the base 70 of the fixed blade 7 on the side of the pivot 80 opposite from the cutting part 8*a* of the first movable blade 8A to tilt the first movable blade 8A to the fixed blade 7. As shown in FIG. 4, a long hole 810 fitted to a driving pin 15 of a driving gear 14 and a driving pin 82 protruded upward in the vicinity are provided to the first movable blade 8A.

A second movable blade 9A in this embodiment includes a substantially square member, and a cutting part 9*a* and a movement guiding part 9*b* respectively similar to those in the above embodiment are formed. As for the second movable blade 9A, a long hole 91 extended in a direction shown by an arrow A is formed in the vicinity of the front end, and a long hole 90 extended in the direction shown by the arrow A is formed in the vicinity of the rear end opposite from the long hole 91. Further, a driving pin 32 protruded upward is provided.

As shown in FIG. 5(*b*), a pressure shaft 92 is attached to the cutter frame 5 and pierces the long hole 90. A helical compression spring 93 for pressing the second movable blade 9A on the fixed blade 7 and supporting sections 50 and 51 (described later) is wound via a pressure washer 94 on the pressure shaft 92.

As shown in FIG. 4, the second movable blade 9A is arranged so that its movement guiding part 9*b* is on the fixed blade 7 and is supported by the supporting sections 50 and 51 provided to the cutter frame 5. In this case, if the thickness of the fixed blade 7 is a, the thickness of the supporting section 50 is b and the thickness of the supporting section 51 is c, it is desirable that relationship among them is set to "a>b>c". That is, by composing as described above, a line to the tip of the cutting part 9*a* of the second movable blade 9A is tilted toward the fixed blade 7, the condition of crossing and sliding required for cutting recording paper S is secured, and stable cutting of the recording paper S is enabled.

Also, the long hole 91 extended in the direction shown by the arrow A is formed at one edge of the second movable blade 9A, and a spindle 31 which pierces the long hole 91 is provided to a part of the cutter frame 5 corresponding to the long hole 91. A long link lever 30 is provided to the spindle 31 so that the link lever can be turned. A long hole 33 is provided to the central side of the link lever 30, and the long hole 33 is fitted to a driving pin 32 of the second movable blade 9A.

Further, a long hole 34 is provided to the end of the link lever 30, and a link mechanism is defined by fitting the driving pin 82 of the first movable blade 8A and the long hole 34 of the link lever 30.

In this embodiment, when the driving motor M is driven, its torque is transmitted to the driving gear 14 via the motor gear 11, the reduction gear 12 and the worm 13, the driving gear 14 is rotated, and the first movable blade 8A is rotated in a direction shown by an arrow B. Simultaneously, the link lever 30 is rotated in a direction shown by an arrow C, and the second movable blade 9A is moved by distance L in the direction shown by the arrow A. As a result, the first and second movable blades 8A and 9A are moved from a position shown by a full line in FIG. 4 to a position shown by an alternate long and two short dashes line, and the recording paper S is cut. In this case, the cutting part 8*a* of the first movable blade 8A and the cutting part 9*a* of the second movable blade 9A are separated by a predetermined distance (width left after cutting) K in a part in which they are adjacent, and recording paper S is cut with the recording paper left by the predetermined width K left after cutting.

As described above, according to this embodiment, as the so-called scissors-type first movable blade 8A is used, a left part after cutting of recording paper S can be set to a position other than the side of the recording paper S as in the above embodiment, and a driving force for moving the first and second movable blades 8A and 9A can be reduced. Further, as only the first movable blade is a scissors type, the size in the direction of the width of recording paper S is not required to be increased, and the cutter device with the sharpness of the blades can be provided.

As the other configuration, action and effect are the same as those in the above embodiment, the description thereof is omitted.

Figure 7:
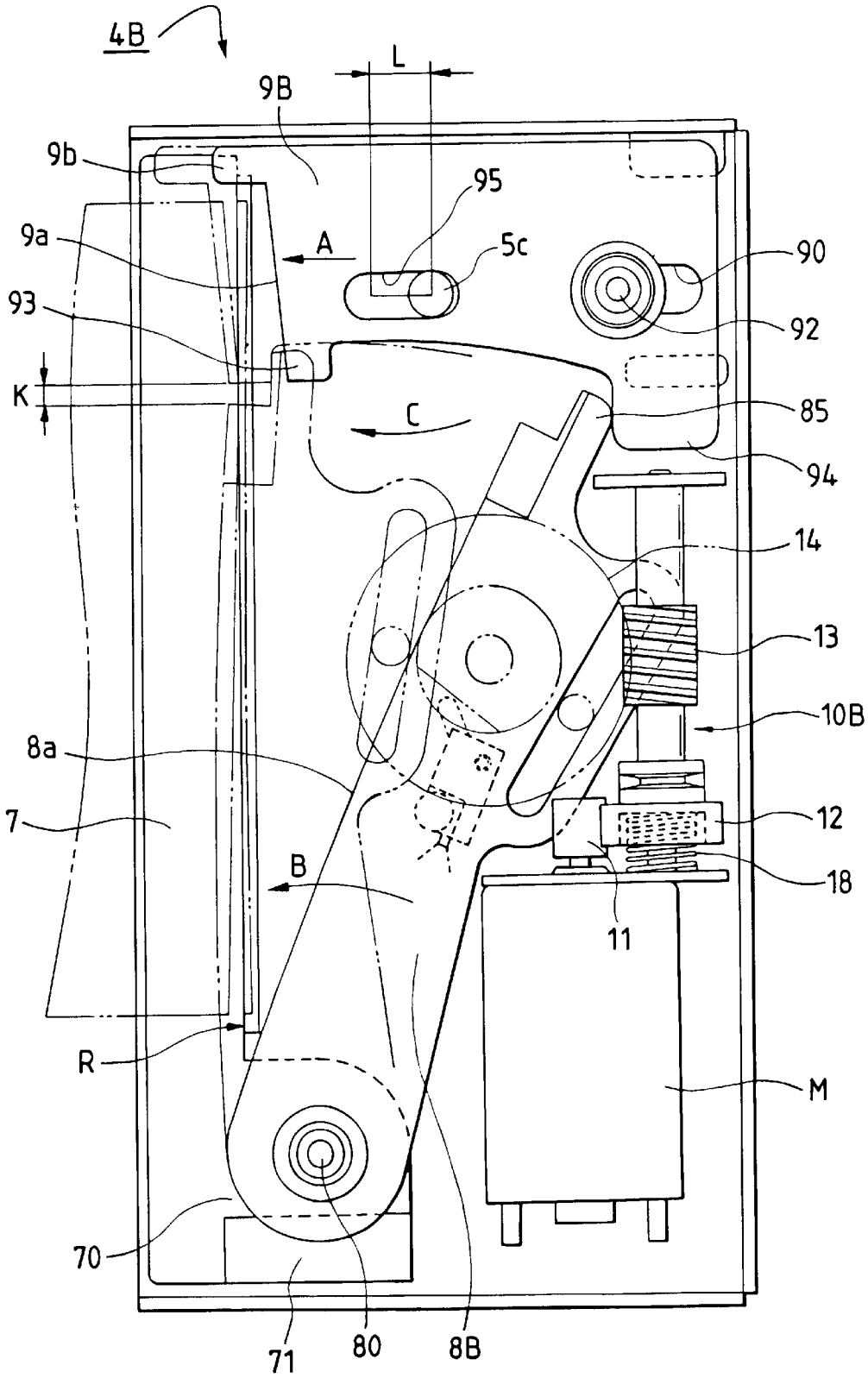
FIG. 7 is a plan showing the configuration of a third embodiment of the present invention.

FIG. 7 is a plan showing the configuration of a third embodiment of the cutter device according to the present invention.

In this embodiment, a second movable blade 9B is moved without using a link lever in a driving mechanism 10B, and the same reference numbers are allocated to parts common to the parts in the above embodiment.

As shown in FIG. 7, in this embodiment, an engaging portion 85 is formed at the end of a first movable blade 8B, and two engaging portions 93 and 94 for engaging with the engaging portion 85 of the first movable blade 8B are formed in the second movable blade 9B. The engaging portions 93 and 94 of the second movable blade 9B are formed at a predetermined interval, and the engaging portion 85 comes in contact with the engaging portions 93 and 94 of the second movable blade 9B by turning the first movable blade 8B.

Also, in this embodiment, a guide pin 5*c* is provided to a cutter frame 5, and the guide pin 5*c* is fitted into a guide hole 95 extended in a direction shown by an arrow A and formed on the second movable blade 9B.

In this embodiment, when a driving motor M is driven, its torque is transmitted to a driving gear 14 via a motor gear 11, a reduction gear 12 and a worm 13, the driving gear 14 is rotated, and the first movable blade 8B is rotated in a direction shown by an arrow B. As a result, a part on one side of recording paper S is cut by the cutting part 8*a* of the first movable blade 8B, the second movable blade 9B is moved in the direction shown by the arrow A by engaging the engaging portion 85 of the first movable blade 8B to the engaging portions 93 of the second movable blade 9B, a part on the other side of the recording paper S is cut, and the recording paper S is cut with only the predetermined width K after cutting left.

As described above, according to this embodiment, as no link lever is used, a left part after cutting of recording paper S can be set to a position other than the side of the recording paper S, and the configuration can be further simplified. As the other configuration, action and effect are the same as those in the above embodiments, the detailed description thereof is omitted.

Figure 8A:
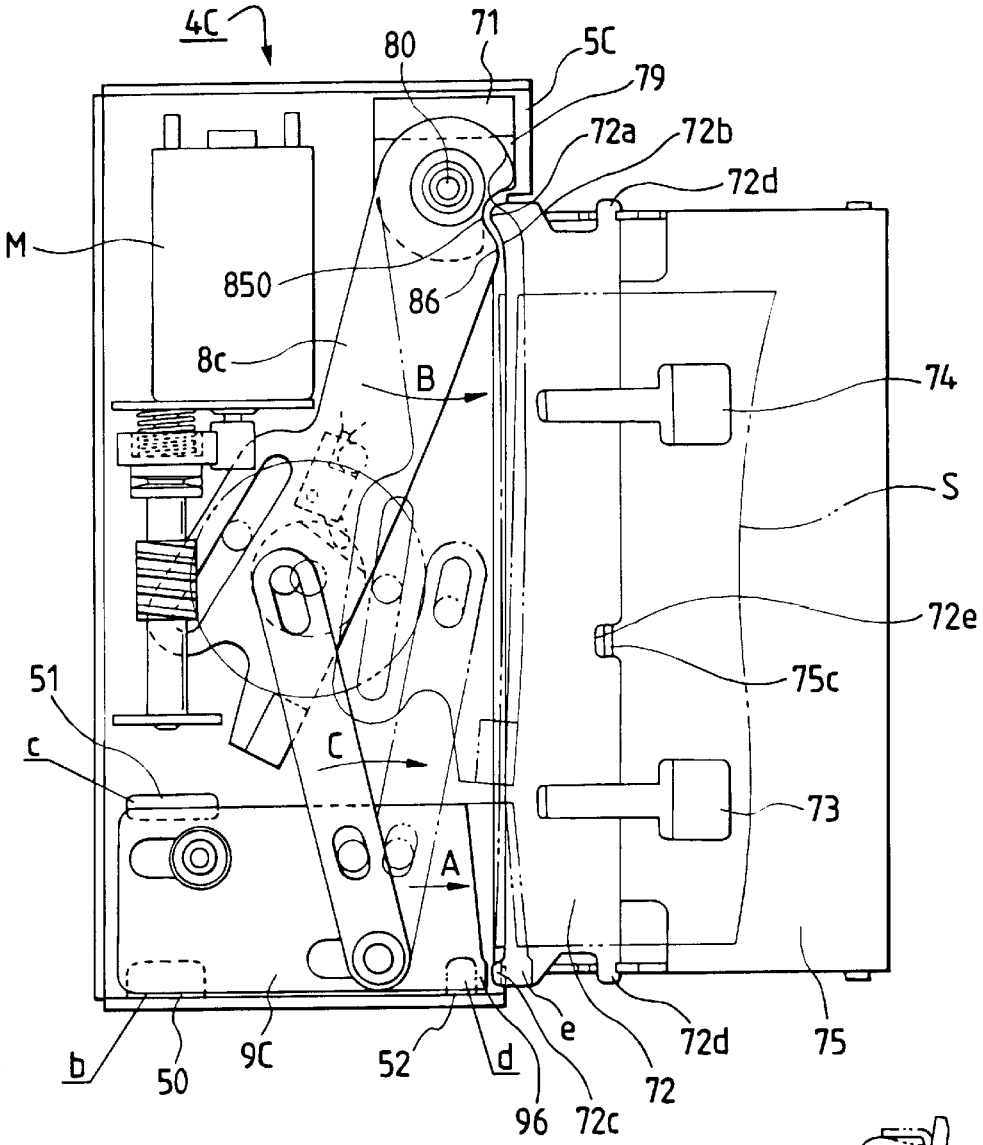
FIGS. 8(*a*) and 8(*b*) are a plan and a side view respectively showing the configuration of a fourth embodiment of the present invention.
Figure 8B:
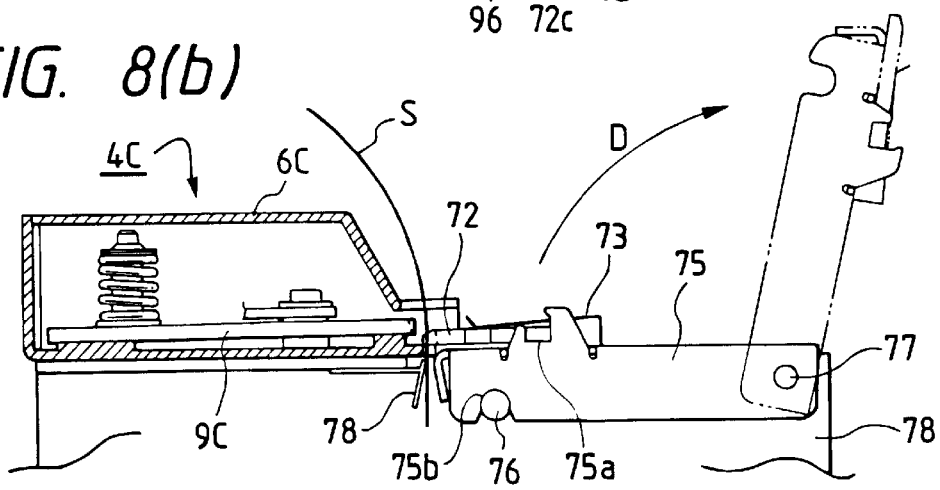

FIGS. 8(*a*) and 8(*b*) show the configuration of a fourth embodiment of the cutter device according to the present invention. FIG. 8(*a*) is a plan view showing the cutter device according to the present invention, a cutter cover 6C covering the upper surface is not shown to show the internal structure, and FIG. 8(*b*) is a front view showing the configuration of the cutter device. In this embodiment, a fixed blade 72 is included so that it can be moved from a cutting position opposite to movable blades 8*c* and 9*c* to a position in which the fixed blade is separated from the movable blades. The same reference numbers are allocated to parts common to those in the above embodiments.

As shown in FIG. 8(*b*), the fixed blade 72 is attached to a fixed blade frame 75 supported by the spindle 77 of a base 78 so that the fixed blade can be turned. A first movable blade 8C is attached to a pivot 80 via a movable blade supporting part 79 having the same thickness as the fixed blade 72. A spacer 71 is fixed to the movable blade supporting part 79 to tilt the first movable blade 8C toward the fixed blade 72.

As shown in FIG. 8(*a*), the first movable blade 8C is provided with a twisted part 850 in the vicinity of the pivot 80, while the fixed blade 72 is provided with a convex portion 72*a* opposite to the twisted part 85 near the twisted part when the fixed blade 72 is located in a cutting position. Hereby, when the first movable blade 8C is turned in a direction shown by an arrow B, a clipping type cutting condition is secured by locating a convex portion 86 of the first movable blade 8C on a concave portion 72*b* of the fixed blade 72.

A second movable blade 9C is provided with a convex portion 96 outside a transport path and the fixed blade 72 is provided with a convex portion 72*c* having a slope for guiding the second movable blade 9C upward in a position opposite to the convex portion 96. Hereby, when the second movable blade 9C is moved in a direction shown by an arrow A, a slide-type cutting condition is secured by locating the convex portion 96 on the convex portion 72*c*.

The second movable blade is supported by supporting sections 50, 51 and 52 provided to a cutter frame 5C, and if the thickness of the respective supporting sections is b, c and d and the thickness of the fixed blade 72 is e, it is desirable that relationship among them is set to "e>d>c".

A convex portion 72*d* and a concave portion 72*e* are provided to the fixed blade 72, the convex portion 72*d* of the fixed blade is fitted into a fixed blade supporting part 75*a* provided to a fixed blade frame 75 so that the convex portion 72*d* can be swung, and the concave portion 72*e* of the fixed blade 72 is fitted to a projection 75*c* provided to the fixed blade frame 75 to decide the right and left positions of the fixed blade 72. The fixed blade 72 is pressed on the fixed blade frame 75 by plate springs 73 and 74 provided to the cutter frame 5C.

As shown in FIG. 8(*b*), as to the fixed blade frame 75, a position when recording paper is cut is decided by pressing a notch 75*b* on a stopper shaft 76 provided to the base 78.

In this embodiment, when recording paper S is set in a printer, the fixed blade frame 75 is turned in a direction shown by an arrow D and the fixed blade 72 is separated from the first and second movable blades 8C and 9C. Rolled paper for example is housed in a housing not shown via an opening, and the setting of recording paper is completed by turning the fixed blade frame 75 in a direction reverse to the direction shown by the arrow D with the upper end of recording paper S pulled out upward from a cover frame 6C until the fixed blade frame is touched to the stopper shaft 76.

As described above, according to the present invention, since paper is not required to pass the narrow clearance between the first or second movable blade 8C or 9C and the fixed blade 72 when recording paper S is set, the design of a transport path of recording paper S is facilitated, paper jam is not a concern, and the setting of recording paper is also simplified. Further, even if paper jam occurs, the fixed blade frame 75 is turned in the direction shown by the arrow D, and jammed paper can be easily removed.

The present invention is not limited to the above embodiments and can be varied.

For example, in the first embodiment, the first and second movable blades are different in size, however, the present invention is not limited to this, and the first and second movable blades can be also included so that the length of each cutting part of the first and second movable blades is equal, and a central part in the width of paper is left after cutting. In the above embodiment, for a cutting method, a sliding type is adopted, however, one movable blade may be also formed so that it is another type such as Guillotine cutter device with sawteeth. Also, the fixed blade is shared by the first and second movable blades, however, the fixed blade can be also individually provided to each movable blade.

Further, in the above embodiments, the example of the cutter device for cutting one recording paper is described, however, the present invention is not limited to this and can be also applied to a cutter device for cutting two parallel mediums of recording paper. However, the present invention is most effective applied to a cutter device for cutting one medium of recording paper with a part left after cutting as in the above embodiments.

Furthermore, the present invention can be applied to not only a dot impact printer but various printers such as a thermal printer and an ink-jet printer.

What is claimed is:

1. A cutter device for cutting recording paper on a transport path, the cutter device comprising:

a fixed blade disposed on a first side of the transport path;

a first movable blade generally disposed facing the fixed blade, the first blade being displaceable between a waiting position spaced from the fixed blade on a second side of the transport path and a cutting position across the transport path to slidably cross the fixed blade;

a second movable blade disposed adjacent the first movable blade in a width direction of the recording paper and generally disposed facing the fixed blade, the second blade being displaceable between a waiting position spaced from the fixed blade on the second side of the transport path and a cutting position across the transport path to slidably cross the fixed blade; and a driving mechanism coupled with at least one of the first movable blade and the second movable blade via a pivotally mounted link lever, the driving mechanism pivoting the link lever to move the first movable blade and the second movable blade between the waiting position and the cutting position, wherein at least one of the first movable blade and the second movable blade is rectilinearly displaceable in a direction approximately orthogonal to the transport path.

2. A cutter device according to claim 1, wherein both of the first movable blade and the second movable blade are rectilinearly displaceable in a direction approximately orthogonal to the transport path.

3. A cutter device according to claim 1, wherein the first movable blade and the second movable blade are interlocked by a link mechanism.

4. A cutter device according to claim 1, wherein the first movable blade and the second movable blade comprise engaging portions, the first and second movable blades being interlocked by engaging with the engaging portions.

5. A cutter device according to claim 1, wherein the fixed blade comprises a fixed blade supporting mechanism that separates the fixed blade from the first movable blade and the second movable blade.

6. A cutter device for cutting recording paper on a transport path, the cutter device comprising:

a fixed blade disposed on a first side of the transport path;

a first movable blade generally disposed facing the fixed blade, the first blade being pivotally supported about a fixed pivot and pivotally displaceable between a waiting position spaced from the fixed blade on a second side of the transport path and a cutting position across the transport path to slidably cross the fixed blade;

a second movable blade disposed adjacent the first movable blade in a width direction of the recording paper and generally disposed facing the fixed blade, the second blade being rectilinearly displaceable in a direction approximately orthogonal to the transport path between a waiting position spaced from the fixed blade on the second side of the transport path and a cutting position across the transport path to slidably cross the fixed blade; and a single driving mechanism coupled with at least one of the first movable blade and the second movable blade, the single driving mechanism moving the first movable blade and the second movable blade between the waiting position and the cutting position.

7. A cutter device according to claim 6, wherein the first movable blade and the second movable blade are interlocked by a link mechanism.

8. A cutter device according to claim 6, wherein the fixed blade comprises a fixed blade supporting mechanism that separates the fixed blade from the first movable blade and the second movable blade.

9. A cutter device according to claim 6, wherein the first movable blade and the second movable blade comprise engaging portions, the first and second movable blades being interlocked by engaging with the engaging portions.

10. A cutter device according to claim 9, wherein the single driving mechanism is coupled with the first movable blade, and wherein the engaging portion of the first movable blade engages the engaging portion of the second movable blade to drive the second movable blade between the waiting position and the cutting position.

11. A cutter device for cutting recording paper on a transport path, the cutter device comprising:

a fixed blade disposed on a first side of the transport path;

a first movable blade generally disposed facing the fixed blade, the first blade being displaceable between a waiting position spaced from the fixed blade on a second side of the transport path and a cutting position across the transport path to slidably cross the fixed blade;

a second movable blade disposed adjacent the first movable blade in a width direction of the recording paper and generally disposed facing the fixed blade, the second blade being displaceable between a waiting position spaced from the fixed blade on the second side of the transport path and a cutting position across the transport path to slidably cross the fixed blade; and a driving mechanism coupled with at least one of the first movable blade and the second movable blade, the driving mechanism moving the first movable blade and the second movable blade between the waiting position and the cutting position, wherein at least one of the first movable blade and the second movable blade is rectilinearly displaceable in a direction approximately orthogonal to the transport path, the first movable and the second movable blade including engaging portions, with the first and second movable blades being interlocked by engaging with the engaging portions, wherein the driving mechanism is coupled with the first movable blade, and wherein the engaging portion of the first movable blade engages the engaging portion of the second movable blade to drive the second movable blade between the waiting position and the cutting position.

12. A printer for printing recording paper on a transport path, the printer comprising:

a printer body;

a print head secured to the printer body for printing on the recording paper; and a cutter device for cutting the recording paper, wherein the cutter device comprises:

a fixed blade disposed on a first side of the transport path, a first movable blade generally disposed facing the fixed blade, the first blade being displaceable between a waiting position spaced from the fixed blade on a second side of the transport path and a cutting position across the transport path to slidably cross the fixed blade, a second movable blade disposed adjacent the first movable blade in a width direction of the recording paper and generally disposed facing the fixed blade, the second blade being displaceable between a waiting position spaced from the fixed blade on the second side of the transport path and a cutting position across the transport path to slidably cross the fixed blade, and a driving mechanism coupled with at least one of the first movable blade and the second movable blade via a pivotally mounted link lever, the driving mechanism pivoting the link lever to move the first movable blade and the second movable blade between the waiting position and the cutting position, wherein at least one of the first movable blade and the second movable blade is rectilinearly displaceable in a direction approximately orthogonal to the transport path.

13. A printer for printing recording paper on a transport path, the printer comprising:

a printer body;

a print head secured to the printer body for printing on the recording paper; and a cutter device for cutting the recording paper, wherein the cutter device comprises:

a fixed blade disposed on a first side of the transport path;

a first movable blade generally disposed facing the fixed blade, the first blade being pivotally supported about a fixed pivot and pivotally displaceable between a waiting position spaced from the fixed blade on a second side of the transport path and a cutting position across the transport path to slidably cross the fixed blade;

a second movable blade disposed adjacent the first movable blade in a width direction of the recording paper and generally disposed facing the fixed blade, the second blade being rectilinearly displaceable in a direction approximately orthogonal to the transport path between a waiting position spaced from the fixed blade on the second side of the transport path and a cutting position across the transport path to slidably cross the fixed blade; and a single driving mechanism coupled with at least one of the first movable blade and the second movable blade, the single driving mechanism moving the first movable blade and the second movable blade between the waiting position and the cutting position.

* * * * *